US008221300B2

(12) United States Patent
Sherman et al.

(10) Patent No.: US 8,221,300 B2
(45) Date of Patent: Jul. 17, 2012

(54) HOLDER FOR SUPPORTING TEST TUBES SIDE BY SIDE ON A RACK, AND HAVING A RESILIENT MOUNTING FLANGE CONNECTING THE TUBES TO ALLOW THE HOLDER TO BEND AND FIT INTO AN ANGULAR SLOT OF A CENTRIFUGE ROTOR

(76) Inventors: Yury Sherman, Roslindale, MA (US); Michael Sherman, Newton, MA (US); Ian Glasgow, Averill Park, NY (US)

( * ) Notice: Subject to any disclaimer, the term of this patent is extended or adjusted under 35 U.S.C. 154(b) by 93 days.

(21) Appl. No.: 12/804,462

(22) Filed: Jul. 22, 2010

(65) Prior Publication Data

US 2010/0298108 A1 Nov. 25, 2010

Related U.S. Application Data

(63) Continuation-in-part of application No. 11/773,386, filed on Jul. 3, 2007, now abandoned.

(51) Int. Cl.
*B04B 5/02* (2006.01)
*B01L 9/06* (2006.01)

(52) U.S. Cl. ..... 494/16; 422/548; 422/562

(58) Field of Classification Search ..... 494/16–21, 494/31–34, 85; 211/74; 422/560–562, 548
See application file for complete search history.

(56) References Cited

U.S. PATENT DOCUMENTS

| | | | | |
|---|---|---|---|---|
| 3,186,556 | A * | 6/1965 | Forsstrom | 211/74 |
| 3,521,785 | A * | 7/1970 | Soelter et al. | 220/23.4 |
| 3,680,967 | A * | 8/1972 | Engelhardt | 356/246 |
| 5,048,957 | A * | 9/1991 | Berthold et al. | 356/246 |
| 5,538,493 | A * | 7/1996 | Gerken et al. | 494/16 |
| 5,616,301 | A * | 4/1997 | Moser et al. | 422/64 |
| 5,683,659 | A * | 11/1997 | Hovatter | 422/548 |
| 5,720,406 | A * | 2/1998 | Fassbind et al. | 220/23.4 |
| 5,935,524 | A * | 8/1999 | Bass et al. | 422/562 |
| 6,001,310 | A * | 12/1999 | Shaffer et al. | 422/548 |
| 6,045,494 | A * | 4/2000 | Toyama | 494/16 |
| 6,190,300 | B1 * | 2/2001 | Demsia et al. | 494/16 |
| 6,543,100 | B1 * | 4/2003 | Finley et al. | 24/555 |
| 6,601,725 | B2 * | 8/2003 | Lafond et al. | 220/23.4 |
| 2010/0031760 | A1 * | 2/2010 | Sherman et al. | 494/20 |
| 2010/0298108 | A1 * | 11/2010 | Sherman et al. | 494/20 |

FOREIGN PATENT DOCUMENTS

SU 1402302 A1 * 6/1988

* cited by examiner

*Primary Examiner* — Charles E Cooley
(74) *Attorney, Agent, or Firm* — K. Gibner Lehmann

(57) ABSTRACT

A centrifuge having two arcuate slots to receive resilient, bendable mounting flanges that each carry a plurality of test tubes in side by side relation. The resilience of the mounting flanges enables them to flex and assume either the curvature of the slot, or a linear configuration enabling the flanges to be suspended in a flat condition, such as on a test rack. The arrays of test tubes is attached to the flanges via living hinges that enable the flexing to occur. The advantages are that simplified identification of individual test tubes, as well as reduced likelihood of intermixing of spillage are realized.

5 Claims, 4 Drawing Sheets

HOLDER FOR SUPPORTING TEST TUBES SIDE BY SIDE ON A RACK, AND HAVING A RESILIENT MOUNTING FLANGE CONNECTING THE TUBES TO ALLOW THE HOLDER TO BEND AND FIT INTO AN ANGULAR SLOT OF A CENTRIFUGE ROTOR

CROSS REFERENCE TO RELATED APPLICATION

The present application is a continuation-in-part of our application Ser. No. 11/773,386 filed Jul. 3, 2007, now abandoned.

BACKGROUND OF THE INVENTION

1. Field of the Invention

The present invention relates generally to the field of scientific research, and more particularly to a system for controlling and maintaining vessels used in scientific research.

2. Description of the Related Art

Scientific research and more particularly biomedical research often requires the separation of fractions in complex mixtures by centrifugation. This is a very widespread procedure both in biomedical research and general clinics. Often this procedure is performed with multiple receptacles, such as test tubes. An example of the procedure utilized may be summarized as follows: the tubes are placed in a rack and filled with various solutions and mixtures (generally "media"), for example cell or tissue lysates or similar material that are to be subjected to homogenization, mixing, resuspension, or other treatments; the tubes with media are taken from the rack and manually placed in a centrifuge rotor; next, centrifugation is employed; after centrifugation the tubes are manually taken from the rotor one-by-one, and finally are transferred back to the rack for further storage, testing, treatments and/or recording. These procedures are tedious and often lead to mistakes in placing the tubes in order, eventually leading to errors in experimental results. There is often very little in the way of quality control that is possible for such a method.

Therefore it is clear that there also exists a fundamental problem in the design of tube holders and racks used for holding test vessels. Centrifuge rotors are designed to include a circle shape that allows for placement of vessels in such a way that they are located equidistantly from the center of rotation of the rotor. In contrast, tube holders and racks are typically fashioned in a linear shape to allow for convenient treatment of tubes by an operator. Therefore, the shapes of centrifuge rotors and the racks are incompatible.

What is required is a system that allows for placement of test tubes in a group from a rack to a centrifuge rotor that reduces manual operations and the accompanying errors in testing which are virtually inevitable.

BRIEF SUMMARY OF THE INVENTION

The present invention is believed to have at least some of the following objects:

To provide a system that allows for placement of test tubes in a group from a rack to a centrifuge rotor and return them back to the rack after the centrifugation, for storage or subsequent procedures.

To solve the problems associated with the prior art by the development of a flexible tube holder that can be transferred from a rack to a centrifuge rotor together with test tubes and can be coupled with the rotor and the rack. The tube holder preferably comprises a material, which can be elastically deformed along each of its axes.

According to one embodiment of the present invention, test tubes are placed in distinct vertical openings, one opening for one tube, of the tube holder. The entire holder may then be placed on a rack that may provide for linear or non-linear storage by means of a carrying shoulder that is integral to the holder. The centrifuge may also include a docking mechanism that is also compatible with the carrying shoulder. The docking mechanism then allows for placement of the holder within the centrifuge where centrifugation may take place. After centrifugation the tube holder together with test tubes may be removed from the rotor and placed back onto the rack. Because the arrangement of the tubes is fixed, i.e. the order of adjacent tubes cannot change, one label for the group of tubes will suffice rather than separate labels on each of the 12 or so individual tubes. This saves the user significant effort and time.

More particularly the invention provides a centrifuge system for positioning a plurality of individual, separate and distinct test tubes in desired, predetermined arrangements, said system comprising in combination a centrifuge mechanism having a rotor provided with at least a pair of arcuate slots, each of which has a predetermined arcuate length and a predetermined width, and an external angular shoulder surrounding the slots, test tube holder means for mounting one or more test tubes in side-by-side relation, said holder means having a mounting flange characterized by a predetermined length and width, and being constituted of resilient material capable of flexure between a substantially flat condition and a substantially curved condition, said mounting flange length being significantly longer than its width, and a plurality of substantially cylindrical tubes each one having one end mounted to said flange at one side thereof by means of a living hinge, and said tubes being open at each of their opposite ends, said tubes further having their other ends substantially free and unattached and being normally disposed to be coextensive with and spaced from each other and coextensive with but spaced substantially from said flange by a uniform distance, said cylindrical tubes each having a diameter at least as large as the diameter of said test tubes, said flange length being less than the respective slot length of the mechanism rotor slots, and said flange thickness being less than the thickness of the respective slot thickness of the mechanism rotor slots, the resilience of the mounting flange enabling it to flex and assume the curvature of its respective slot, and the living hinges at the ends of the respective tubes permitting the tubes to flex to a position in the mechanism rotor, spaced from the flange, disposed at an angle with respect thereto, and to remain held captive thereby, such that the tubes flare outwardly radially with respect to the mechanism rotor and lie against the external angular shoulder thereof when the centrifuge is operated.

BRIEF DESCRIPTION OF THE DRAWINGS

These and other features, aspects and advantages of the present invention will become better understood with reference to the following description, appended claims and accompanying drawings, in which:

DETAILED DESCRIPTION OF THE INVENTION

Figure 1:
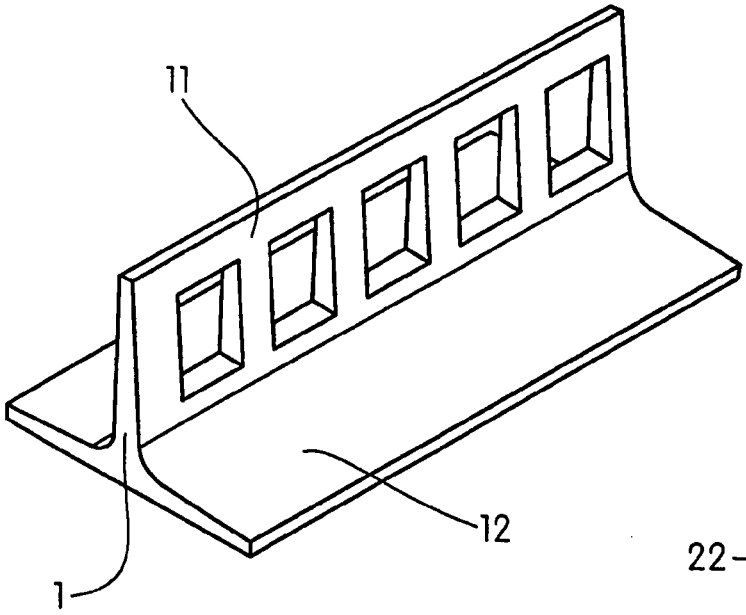
FIG. 1 illustrates an isometric view of a tube rack.

In general, the invention provides a centrifuge system for positioning a plurality of individual, separate and distinct test tubes in desired, predetermined side-by-side arrangements. The system includes, in FIG. 1, a rack 1, having substantially linear wall 11 and supporting pad 12 providing stability of the rack. Thickness and length of wall 11 is suitable for coupling a removable tube holder 2, FIG. 2.

Figure 2:
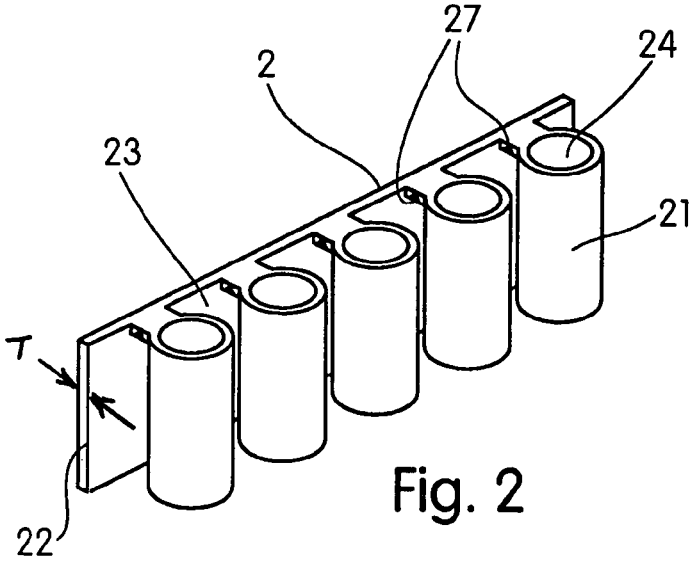
FIG. 2 illustrates a fragmentary isometric view of a replaceable tube holder.

In FIG. 2, a portion of tube holder 2 is shown comprising a plurality of tube cells 21 and a carrying shoulder or mounting flange 22 that is capable of flexure. The latter has a predetermined length and width. Its length is longer than its width, as shown. The thickness of the flange is labeled T.

The tube cells are cylindrical, and have a length M that is less than the length of the test tubes that are to be inserted in the aperture 24 of the respective tube cell. See FIG. 5. Inserted test tubes thus project completely from the lower end of the cells 21, as shown. It is noted that the tube cells 21 are coextensive with the mounting flange when the holder is placed on the rack, but become angularly disposed with respect to the flange and with respect to each other when the holder is installed in a centrifuge mechanism rotor, as will be seen hereinafter. Moreover, the tube cells, when placed in the rack along with the mounting flange 22, are each closely juxtaposed to the linear wall 11 and to each other, and respectively disposed on opposite sides of said linear wall.

As shown, the uppermost portions of the tube cells are spaced a finite distance from one another regardless of whether the test tube holder is installed on or removed from the centrifugal mechanism rotor. The cells are disposed side-by-side, and are all substantially uniform with respect to one another, as to their inner and outer diameters, and their respective lengths. Each cell carries a separate test tube, as opposed to an arrangement where tandem, integrated test vessels are utilized instead.

Figure 3:
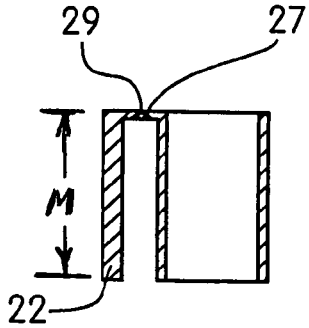
FIG. 3 illustrates a cross sectional view of a tube holder.
Figure 4:
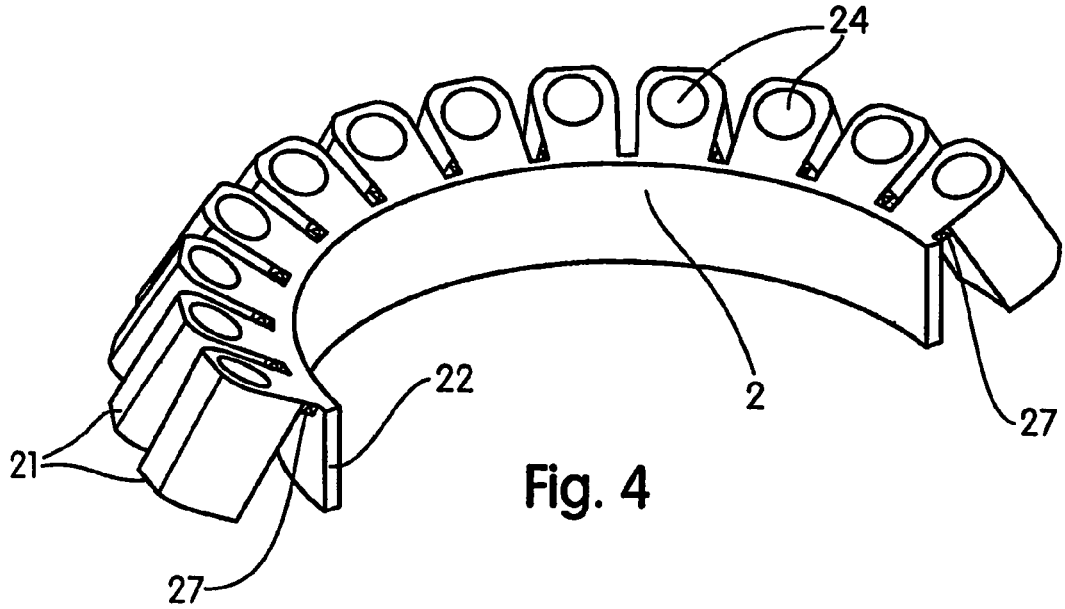
FIG. 4 illustrates an isometric view of the tube holder bent for installation in a centrifuge rotor.

The tube holder 2, also referred to as a test tube holder means, also comprises portions defining cell gaps or spaces 23 between the pluralities of tube cells 21, which provide for angular displacement of adjacent tube cells 21 when a carrying shoulder or mounting flange 22 is deformed in an angular manner. Carrying shoulder 22 is integrated with the tubes or tube cells 21 by a connecting member 29 located at a top portion of the tube holder 2, as shown in FIG. 3. The connecting member 29 includes resilient living hinges 27 along the carrying shoulder or mounting flange 22, providing either zero or else finite angular displacements of cells 21 about the carrying shoulder 11. Thus, when the carrying shoulder 22 is bent, cells 21 are able to flare out and take a shape shown in FIG. 4 that is suitable for installation of the tube holder 2 into the circular centrifuge rotor.

The more elastic or resilient the tube holder 2 is, the more easily the carrying shoulder 22 may be flexed angularly and temporarily deformed, and thus assume a curvature that will adapt to an arcuate slot in a centrifuge rotor. The length of the carrying shoulder is seen to be less than the length of the slot parts in the centrifuge rotor, as shown.

When the carrying shoulder 22 is inserted in the slot part of the centrifuge rotor, the tube cells are flared outwardly to rest against the external conical outer, angular shoulder of the centrifuge rotor. However, increase of elasticity or resiliency decreases the ability of tube holder 2 to restore its linear shape when the holder is removed from a centrifuge rotor to be placed in rack 1, shown in FIG. 1. To balance these contrary features, a flat steel spring can be coupled with carrying shoulder 22 which increases the ability of the carrying shoulder 22 to regain its linear shape.

Figure 5:
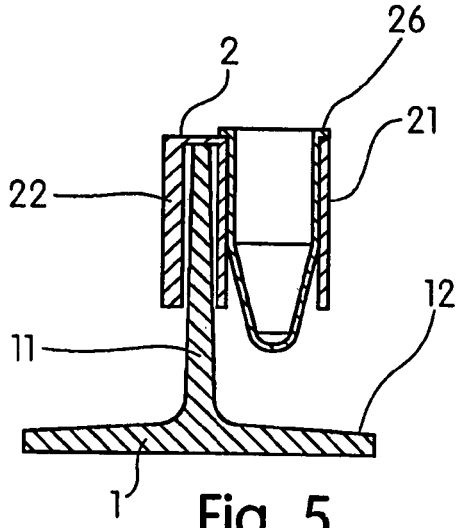
FIG. 5 illustrates a cross sectional view of a tube holder filled with the tubes, placed upon the rack.

FIG. 5 shows a cross sectional view of the tube holder 2 with a test tube 26 on a rack 1. By the invention, in FIG. 11, the upper part of wall 11 of the rack contacting with carrying shoulder or mounting flange 22 and cells 21 can be angled at one or both sides of the wall to keep the tubes at the same angle as in the centrifuge rotor.

Figure 6:
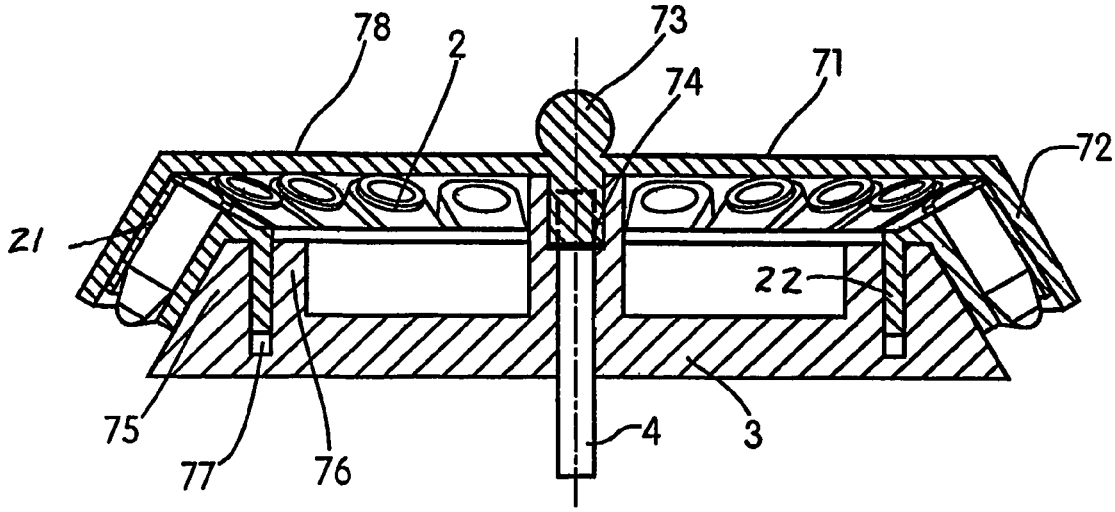
FIG. 6 illustrates a cross sectional view of the centrifuge rotor with installed tube holder filled with the tubes, ready for centrifugation.
Figure 7:
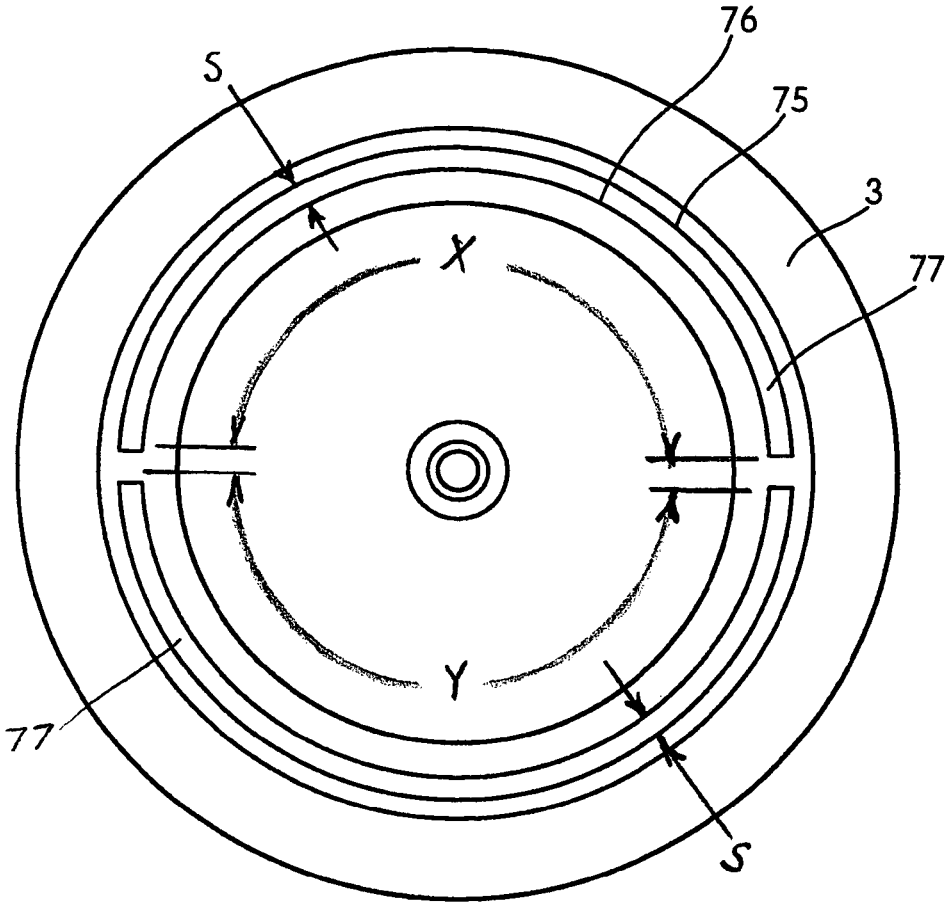
FIG. 7 illustrates a top view of the rotor showing two sections for the tube holders.

FIGS. 6 and 7 illustrate rotor 3 attached to centrifuge shaft 4 that comprises a structure suitable for accommodation of tube holder 2. The rotor 3 comprises a first vertical circular wall 75 and a second circular wall 76 along the perimeter of the rotor 3, forming slot 77 between them. Slot 77 has a width that is capable of accommodating the carrying shoulder 22 of tube holder 2, which carrying shoulder has a thickness T. Installation of the tube holder 2 in the rotor 3 is accomplished by insertion of the carrying shoulder 22 into slot 77. First circular wall 75 is inclined outside the rotor 3. Due to this, when the tube holder 2 is installed in the rotor 3, tube cells 21, and the individual test tubes therein assume an inclined position about the rotor 3 that is desirable for optimal centrifugation of the tubes.

In a preferred embodiment of the invention, two holders 2 are employed, each holder 2 containing 12 tubes, and both holders 2 are loaded onto rotor 3. Accordingly, slot 77 may be subdivided into two arcuate parts each of which accommodates one tube holder 2, as is illustrated in FIG. 7. There may be a separating wall between the slot parts 77. The lengths of the slot parts are sufficient to accommodate the mounting flange or carrying shoulder 22 of the holder 2, as can be readily understood. The thickness of the slot parts is indicated by the label S, whereas the respective lengths of the slot parts are labeled X and Y, FIG. 7.

To provide stable positioning of tube cells 21 on rotor 3, and in particular to avoid angular displacement of the cells under the applied centrifuge force when rotor 3 is rotated, closure 71 may be used, as shown in FIG. 6. The closure includes top plate 78 attached to the rotor's extension 74, and skirt 72, capable of carrying the centrifuge force. Screw 73 fixes position of closure 78 on rotor 3. Skirt 72 along perimeter of the rotor 3 provides additional support to tube cells 21. Its function is to carry centrifuge force along wall 75, applied to the cells when rotor 3 is rotated.

Figure 8:
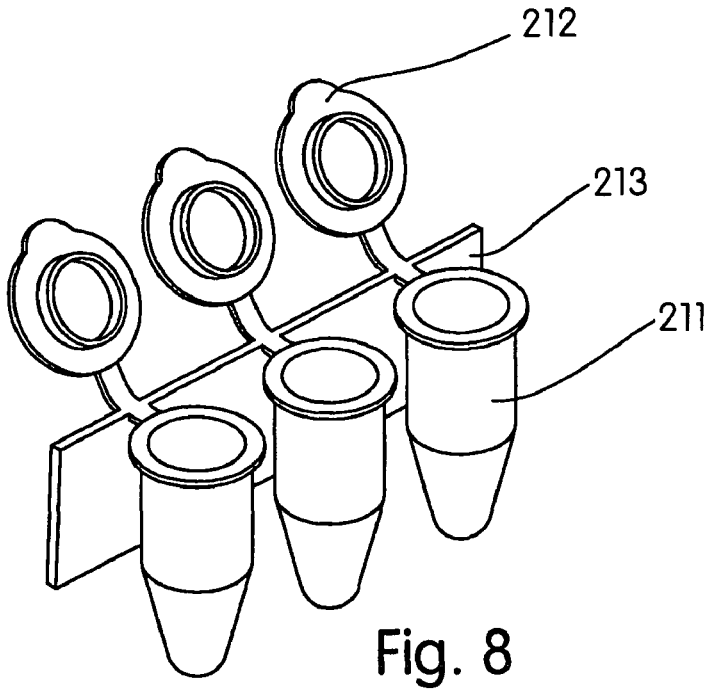
FIG. 8 illustrates a fragmentary isometric view of a second version of a tube holder.
Figure 9:
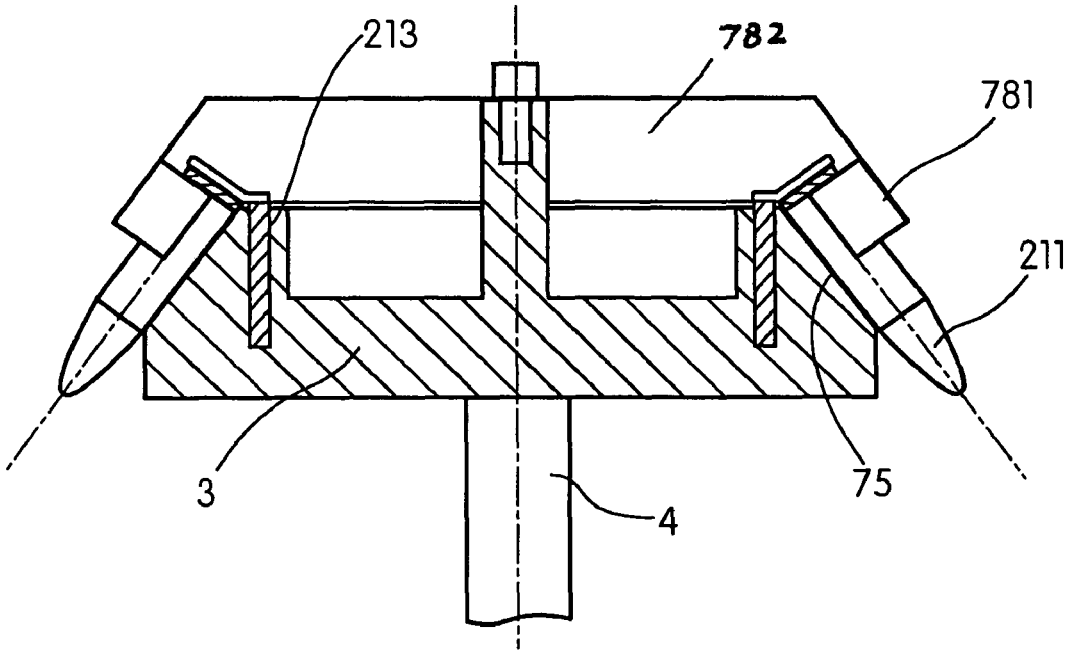
FIG. 9 illustrates a cross sectional view of the centrifuge rotor with installed tube holder of the second version of the invention.

In FIGS. 8 and 9 the second version of the tube holder is shown. Its main difference from the described above is that cells 21 of tube holder 2 are substituted with test tubes 211 having closure caps 212. Accordingly, the tube holder consists of a tube supporting carrying shoulder 213 integrated with a set of test tubes 211. The major advantages of the second version are manufacturing of test tubes and tube holder as one unit. It eliminates manual marking of the tubes that currently is made by the operator. Extensions 781 from the closure 782 embrace test tubes. They carry centrifuge force along wall 75 of centrifuge rotor, applied to tubes 211 when rotor 3 is rotated and avoid angular displacements of the tubes under the centrifuge force.

Figure 10:
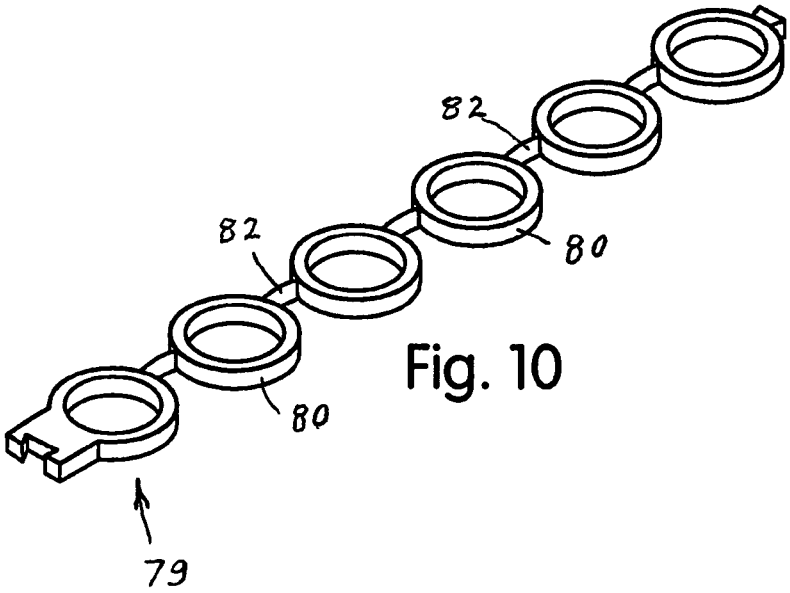
FIG. 10 illustrates a tube holder which relies upon the web between the tube holder rings rather than a separate wall to control the deformed and not-deformed geometric configurations (isometric view of rings connected by webs).
Figure 11:
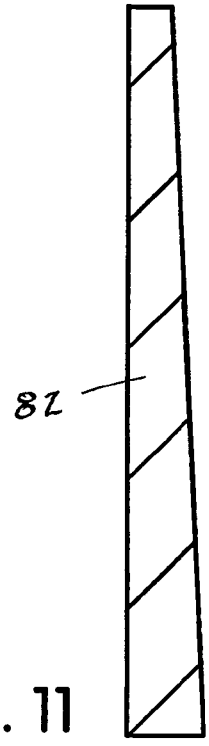
FIG. 11 illustrates the wall of the web or of the separate wall of the tube holders which encourages the tubes to flare out as the tube holder is bent into an arc. (trapezoidal cross section of wall).

In FIGS. 10 and 11 still another version of the invention is shown. FIG. 10 shows a tube holder 79 comprising a line of rings 80 in which tubes can be placed. The web 82 between the rings 80 acts as a living hinge and controls the bending of this rack into an arc. FIG. 11 shows cross-sectional view of the web in FIG. 10. Note that it is thicker towards the bottom so that as the tube holder is deformed into an arc, the holders tilt such that tubes in them would splay outward, i.e. the tubes would be inclined with the bottoms pointing outward and downward.

The present invention also includes a method for storing, transferring, centrifugation, and/or recording of research vessels. The vessels may comprise microcentrifuge test tubes of 1.5-2 ml. volume. The process starts from preparation of test tubes for the centrifugation including placing test tubes in the tube rack, filling the tubes with media; recording the tubes as desired; transferring the tube holder and tubes in a group to the centrifuge. Then, after centrifugation, the tube holder and tubes are transferred back to the rack for their further storing or treatment.

Although the present invention has been described with reference to particular embodiments, it will be apparent to those skilled in the art that variations and modifications can be substituted therefor, without departing from the principles and spirit of the invention.

Each and every one of the appended claims defines an aspect of the invention which is separate and distinct from all others, and accordingly it is intended that each claim be treated as such in any determination of novelty or validity.

The embodiments of the invention in which an exclusive property or privilege are claimed are defined as follows:

1. A centrifuge system for positioning a plurality of individual, separate and distinct test tubes in desired, predetermined arrangements, said system comprising in combination:

a) a centrifuge mechanism having a rotor provided with at least a pair of arcuate slots, each of which has a predetermined arcuate length and a predetermined width, and an external angular shoulder surrounding the slots, b) test tube holder means for mounting one or more test tubes in side-by-side relation, said holder means having a mounting flange characterized by a predetermined length and width, and being constituted of resilient material capable of flexure between a substantially flat condition and a substantially curved condition, said mounting flange length being significantly longer than its width, and c) a plurality of substantially cylindrical tubes each one having one end mounted to said flange at one side thereof by means of a living hinge, and said tubes being open at each of their opposite ends, said tubes further having their other ends substantially free and unattached and being normally disposed to be coextensive with and spaced from each other and coextensive with but spaced substantially from said flange by a uniform distance, said cylindrical tubes each having a diameter at least as large as the diameter of said test tubes, d) said flange length being less than the respective slot length of the mechanism rotor slots, and said flange thickness being less than the thickness of the respective slot thickness of the mechanism rotor slots, e) the resilience of the mounting flange enabling it to flex and assume the curvature of its respective slot, and the living hinges at the ends of the respective tubes permitting the tubes to flex to a position in the mechanism rotor, spaced from the flange, disposed at an angle with respect thereto, and to remain held captive thereby, such that the tubes flare outwardly radially with respect to the mechanism rotor and lie against the external angular shoulder thereof when the centrifuge is operated.

2. The invention as set forth in claim 1, wherein:

a) said cylindrical tubes are characterized by a length which shorter than the length of the test tubes, whereby the latter extend axially through the cylindrical tubes and project from the bottoms thereof, respectively.

3. The invention as set forth in claim 1, wherein:

a) the uppermost portions of said cylindrical tubes are spaced a finite distance from one another regardless of the holder being installed on or removed from the mechanism rotor.

4. The invention as set forth in claim 1, wherein:

a) said cylindrical tubes are all substantially uniform with respect to one another, as to their respective inner and outer diameters and their respective lengths.

5. A test tube holder construction for positioning a plurality of individual, separate and distinct test tubes in desired, predetermined arrangements in a rack, or alternately in a centrifuge with a rotor having arcuate slots, said construction comprising in combination:

a) test tube holder means for mounting one or more test tubes in side-by-side relation, said holder means having a mounting flange characterized by a predetermined length and width, and being constituted of resilient material capable of flexure between a substantially flat condition and a substantially curved condition, said mounting flange length being significantly longer than its width, and b) a plurality of substantially cylindrical tubes each one having one end mounted to said flange at one side thereof by means of a resilient living hinge, and said tubes being open at each of their opposite ends, said tubes further having their other ends substantially free and unattached and being normally disposed to be coextensive with and spaced from each other and coextensive with but spaced substantially from said flange by a uniform distance, said cylindrical tubes each having a diameter at least as large as the diameter of said test tubes, c) said flange length being less than the respective slot length of the mechanism rotor slots, and said flange thickness being less than the thickness of the respective slot thickness of the mechanism rotor slots, d) the resilience of the mounting flange enabling it to flex and assume the curvature of its respective slot, and the living hinges at the ends of the respective tubes permitting the tubes to flex from a position wherein they are coextensive with or parallel to the flange when mounted on the rack, to a different relative position in the mechanism rotor that is spaced from the flange and disposed at an angle with respect thereto, and to remain held captive thereby, such that the tubes flare outwardly radially with respect to the mechanism rotor and lie against the external angular shoulder thereof when the centrifuge is operated.

* * * * *